United States Patent [19]

Garnett

[11] Patent Number: 4,903,963

[45] Date of Patent: Feb. 27, 1990

[54] ABDOMINAL MUSCLE EXERCISER

[76] Inventor: Byran R. Garnett, 23 Stowe Ct., Seaside, Calif. 93955

[21] Appl. No.: 300,363

[22] Filed: Jan. 23, 1989

[51] Int. Cl.[4] ..... A63B 21/00

[52] U.S. Cl. ..... 272/130; 272/134

[58] Field of Search ..... 272/72, 96, 118, 130, 272/131, 134, 141, 142, 145; 128/25 B

[56] References Cited

U.S. PATENT DOCUMENTS

| | | | |
|---|---|---|---|
| D. 271,603 | 11/1983 | Berner | 272/130 X |
| 2,689,127 | 9/1954 | Silverton et al. | 272/134 X |
| 3,768,808 | 10/1973 | Passera | 272/142 X |
| 4,618,140 | 10/1986 | Brown | 272/130 X |
| 4,627,610 | 12/1986 | Ishida et al. | 272/72 |
| 4,684,125 | 8/1987 | Lantz | 272/72 |
| 4,687,197 | 8/1987 | Larsson et al. | 272/130 X |
| 4,750,736 | 6/1988 | Watterson | 272/72 |

FOREIGN PATENT DOCUMENTS

| | | | |
|---|---|---|---|
| 1358973 | 12/1987 | U.S.S.R. | 272/130 |

OTHER PUBLICATIONS

ProForm Aerobot, *Superfit,* Nov. 1985, p. 93.

*Primary Examiner*—Richard J. Apley
*Assistant Examiner*—David H. Willse
*Attorney, Agent, or Firm*—Douglas E. White

[57] ABSTRACT

An abdominal muscle exerciser includes a seat and a lever arm which is rotatable in directions toward and away from the seat. The seat and lever arm are attached to a base. A pneumatic cylinder is biased between the base and the lever arm. The cylinder has a resistance stroke which provides significant resistance against rotation of the lever arm in the direction toward the seat. A cross bar is mounted transverse to the lever arm and a pair of foot stirrups are rotatably mounted on the cross bar.

11 Claims, 2 Drawing Sheets

ABDOMINAL MUSCLE EXERCISER

FIELD OF THE INVENTION

This invention relates to physical conditioning and exercise equipment, more particularly to an exerciser for use in strengthening the abdominal muscles.

BACKGROUND OF THE INVENTION

A great deal of mechanical equipment has recently been introduced to assist body builders and exercise enthusiasts and to treat physical injuries.

However, there is no apparatus adapted especially for exercising one's abdominal or stomach muscles. Even in fully mechanized gyms or spas, one still sees exercise enthusiasts doing sit ups or the like for this purpose.

It is true that one can use an inclined table for doing abdominal exercises. Furthermore, one can attach weights directly to one's feet or ankles and do leg lifts. This is time consuming and does not allow for the quick adjustments that are characteristic of mechanized exercisers.

Prior developments in this field will be generally illustrated by reference to the following patents:

| Patent No. | Patentee | Issue Date |
|---|---|---|
| D263,978 | J. D. Brentham | 04/20/82 |
| D271,603 | J. H. Berner | 11/29/83 |
| 4,609,190 | J. D. Brentham | 09/02/86 |
| 4,722,525 | J. D. Brentham | 02/02/88 |
| 3,465,592 | J. J. Perrine | 09/09/69 |
| 3,103,357 | W. E. Berne | 09/10/63 |
| 2,689,127 | R. G. Silverton et al. | 09/14/54 |

A number of the devices of the above patents use pneumatic cylinders to provide resistance to body movement. However, none teach a configuration which applies force to the body in the direction proper for beneficial abdominal muscle exercise.

SUMMARY OF THE INVENTION

The present invention provides automatic resistance against which to do leg exercises for the improvement of abdominal muscles. A cross bar has stirrups for the user's feet. The cross bar is attached to a lever which is free to rotate in a vertical plane about a pivot. The lever is biased against a pneumatic cylinder in a manner analogous, for example, to rowing machines. With the user's feet in the stirrups, the cylinder provides resistance to a new form of exercise that is analogous to a sit up.

The resistance stroke of the cylinder is reversed with respect to that of known machines—i.e. movement is resisted in the direction toward the seat upon which the user rests. Resistance can be varied either by adjusting a gas valve which controls pressure in the cylinder or by changing the point of attachment of the cylinder to the lever.

Alternatively, the cylinder can be replaced with weights on a cable, which cable is entrained over pulleys and led to the lever. Resistance can be varied either by adding or removing weights or by changing the point of attachment of the cable to the lever.

Features and Advantages

An object of this invention is to provide an exerciser device which is effective for strengthening the abdominal muscles.

A further object is to disclose a device which is of simple, lightweight construction in order that it may be inexpensive to purchase and suitable for home or spa use.

Accordingly, there is disclosed herein an abdominal muscle exerciser which includes a seat and a lever arm which is rotatable in directions toward and away from the seat. The seat and lever arm are attached to a base.

Another feature is a pneumatic cylinder which is biased between the base and the lever arm. The cylinder has a resistance stroke which provides significant resistance against rotation of the lever arm in the direction of the seat.

Yet another feature is a cross bar which is mounted transverse to the lever arm and a pair of padded foot stirrups which are rotatably mounted on the cross bar.

Still another feature is a weighted cable system which may be substituted for the pneumatic cylinder.

Other novel features which are characteristic of the invention, as to organization and method of operation, together with further objects and advantages thereof will be better understood from the following description considered in connection with the accompanying drawing in which a preferred embodiment of the invention is illustrated by way of example. It is to be expressly understood, however, that the drawing is for the purpose of illustration and description only and is not intended as a definition of the limits of the invention.

Certain terminology and derivations thereof may be used in the following description for convenience in reference only and will not be limiting. For example, the words "upwardly," "downwardly," "leftwardly," and "rightwardly" will refer to directions in the drawings to which reference is made. The words "inwardly" and "outwardly" will refer to directions toward and away from, respectively, the geometric center of a device and designated parts thereof.

DRAWING REFERENCE NUMERALS

Figure 1:
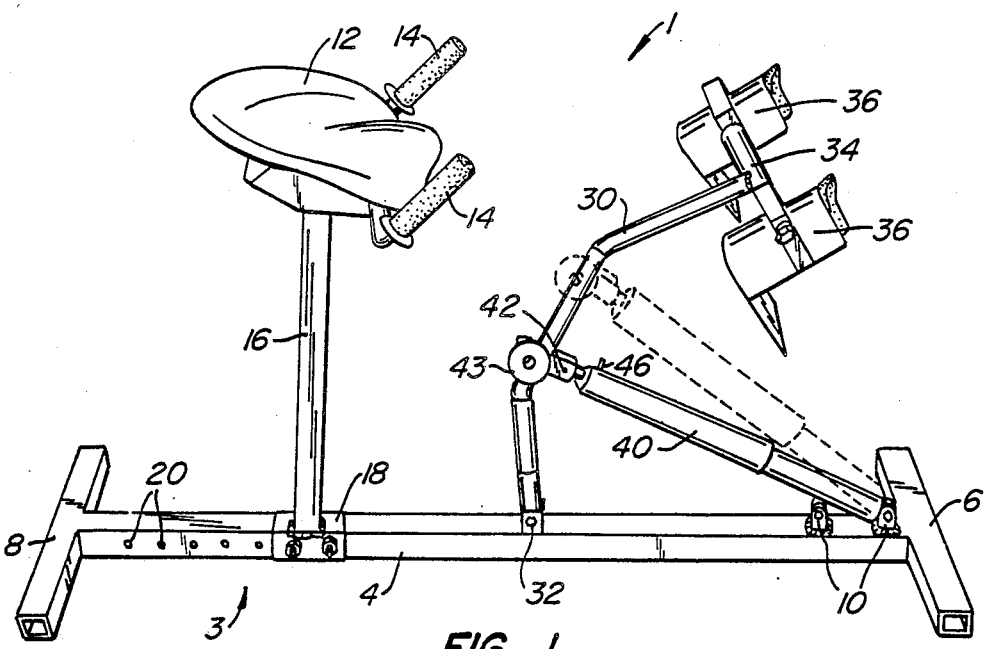
FIG. 1 is a perspective view of a preferred embodiment of the abdominal muscle exerciser of this invention.

1 exerciser
3 base
4 support beam of 3
6 front leg of 3
8 rear leg of 3
10 pivot bracket
12 seat
14 handle
16 support post of 12
18 sleeve
20 mounting hole
24 clevis bracket
26 shaft
30 lever arm
32 pivot bracket of 30
34 cross bar 35 pad
36 stirrup
37 yoke of 36
38 base plate of 36
39 non-skid material
40 pneumatic cylinder
42 clevis bracket of 40
43 knob of 42
46 valve
50 user
52 abdominal muscles of 50
60 cable
62 beam pulley
64 frame
66 weight
68 frame pulley
69 aperture
101 exerciser
103 base
104 support beam of 103
106 front leg of 103
108 rear leg of 103
112 seat
114 handle
116 support post of 112
118 sleeve
120 mounting hole
130 lever arm
132 pivot bracket of 130
134 cross bar
136 stirrup
142 clevis bracket of 140
143 knob of 142

DESCRIPTION OF A PREFERRED EMBODIMENT

Referring to FIG. 1, there is therein illustrated an exerciser 1, broadly comprising base 3, seat 12, lever arm 30, stirrups 36, and pneumatic cylinder 40.

The base 3 of the exerciser has a central support beam 4 to which front leg 6 and rear leg 8 are transversely mounted for stabilizing the device on a support surface. At least one cylinder bracket 10 projects upwardly from the front of the support beam 4 near the front leg for pivotal support of the cylinder 40. A plurality of mounting adjustment holes 20 pierce the sides of the beam. A lever bracket 32 projects upwardly from the midportion of the beam for pivotal support of the lever arm 30.

A seat 12, preferably contoured as illustrated, rests on a support post 16. The bottom of the support post terminates in a moveable sleeve 18, which sleeve may be bolted or pinned through holes 20 in selected positions along the support beam, depending on the height of the user 50.

The seat has a pair of handles 14 mounted on opposite sides thereof. The handles are grasped by the user to provide stability and to oppose the force generated by the user's legs during an exercise session.

In addition to being adjustable back and forth along the support beam 4, the seat may be made adjustable in height by providing means for varying the height of the post 16. For example, the post could be divided into two sections with one section journalled and pinned within the other, in a manner similar to the adjustable sleeve 18. Adjustment of the height of the seat will vary the direction of force applied to the user's abdominal muscles and, thus, vary the beneficial effect of the exercise.

Figure 3A:
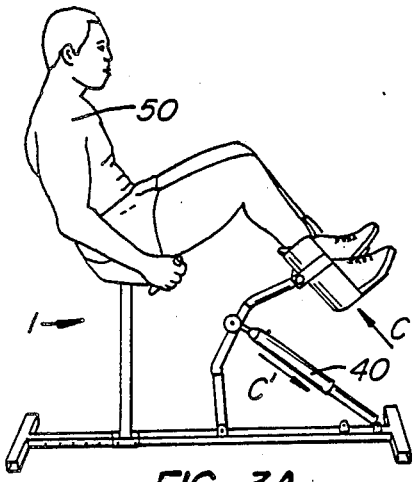
FIGS. 3A and 3B are perspective views of the device of FIG. 1 illustrating the push stroke of an exercise.
Figure 3B:
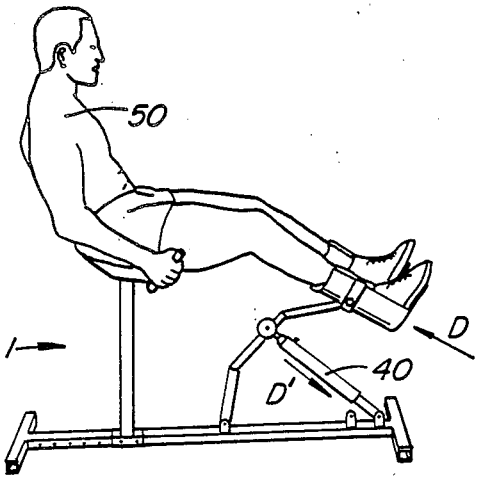

The lever arm 30 preferably curves forward in order both to accommodate the length of the cylinder 40 and to allow full extension of the user's legs within the stirrups 36 (see FIG. 3B.) However, a straight lever arm may be substituted for use in connection with a shorter cylinder without departing from the scope of the invention.

The lever arm 30 is rotatably attached to the bracket 32 at its lower end. At its upper end a cross bar 34 is transversely mounted. Stirrups 36 face forward from opposite ends of the cross bar and are free to rotate during use, as better seen with reference to FIGS. 2, 3 and 5.

The pneumatic cylinder 40 is rotatably affixed at its lower end to a pivot bracket 10 of the support beam 4. At its upper end, facing rearwardly with respect to the base 3, the cylinder is rotatably attached to a clevis bracket 42 mounted on the lever arm 30. The bracket 42 may be released by turning knob 43 so that its position on the arm may be changed, as shown in phantom in FIG. 1. The position of the cylinder 40 shown in phantom will require greater force against the stirrups 36 to extend the cylinder than the position shown in solid, due to the decreased leverage applied against the cylinder by the arm 30 when in the phantom position.

An alternate method of adjusting the force of the pneumatic cylinder 40 (and, hence, the difficulty of the exercise) is to provide a gas bleeder valve 46 on the cylinder.

Figure 5:
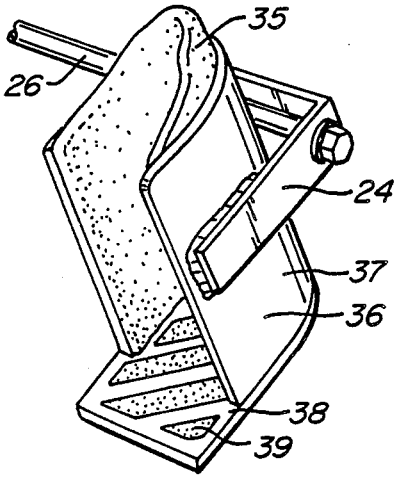
FIG. 5 is a broken perspective view of the device of FIG. 1 showing a stirrup in detail.

Turning briefly to FIG. 5, it can be seen that a stirrup 36 comprises a U-shaped yoke 37 having a base plate 38 affixed in a plane parallel to the plane of its U-shaped cross section. The sole of a user's foot rests against the base plate. Its position is secured by patches of non-skid material 39. The back of the user's lower leg fits into the yoke. The force of the exercise is directed rearwardly against the cross bar 34 via clevis bracket 24 and rotatable shaft 26, the latter of which may be journaled within the cross bar or may be installed within separate bearings (not illustrated). In order to comfort and protect the user's tendon against this force, a contoured pad 35 shields the inner surface of the yoke 37.

Figure 4:
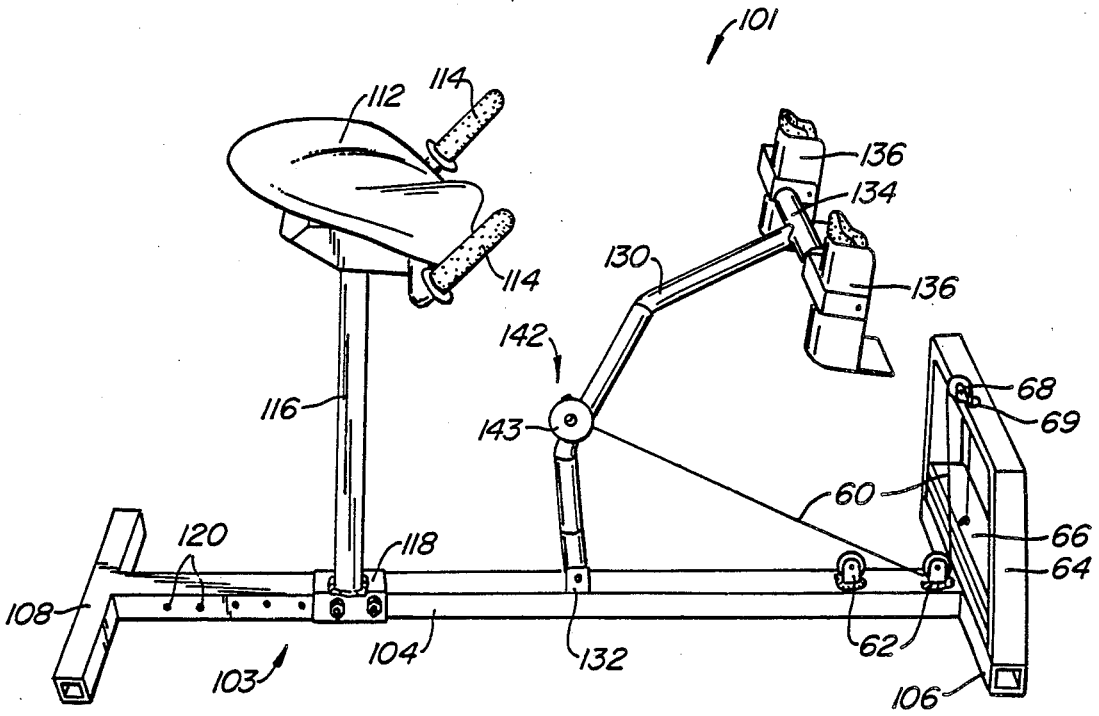
FIG. 4 is a perspective view of another embodiment of the invention.

Referring to FIG. 4, there is illustrated therein an alternate embodiment of this invention, namely, weight driven exerciser 101. It is to be noted for convenient reference that the last two positions of the reference numerals of FIG. 4 duplicate those of the reference numerals of FIG. 1 where they refer to corresponding parts.

The base 103 of the exerciser has a central support beam 104 to which front leg 106 and rear leg 108 are transversely mounted. At least one pulley and bracket 62 projects upwardly from the front of the support beam 104 near the front leg to receive and guide a cable 60. A plurality of mounting adjustment holes 120 pierce the sides of the beam. A lever bracket 132 projects upwardly from the mid-portion of the beam for pivotal support of the lever arm 130.

A seat 112 rests on a support post 116. The bottom of the support post terminates in a moveable sleeve 118, which sleeve may be bolted or pinned through holes 120 in selected positions along the support beam.

The seat has a pair of handles 114 mounted on opposite sides thereof. It may include means for adjusting its height.

The lever arm 130 is rotatably attached to the bracket 132 at its lower end. At its upper end a cross bar 134 is transversely mounted. Stirrups 136 face forward from the opposite ends of the cross bar and are free to rotate during use.

The cable 60 is affixed at its rearward end to clevis bracket 142 mounted on the lever arm 130. The bracket 142 may be released by turning knob 143 so that its position on the arm may be changed in order to alter the force required to move the stirrups.

The cable travels through the beam pulley 62, through a pulley 68 on a weight frame 64 and through an aperture 69 in the top of the frame, whereupon it attaches at its forward end to one or more weights 66. Providing a plurality of weights 66 within the frame 64 that may be cumulatively attached to the cable 60 is another way of adjusting the resistance and, hence, the difficulty of the exerciser 101.

The weights act in a manner similar to a pneumatic cylinder with two differences. First of all, if one halts in the middle of an exercise on exerciser 101, the weights continue to strain the abdominal muscles 52 of the user 50. A similar maneuver in exerciser 1 will cause the strain to cease temporarily, since the cylinder merely resists movement and does not tend to pull back toward the direction from which it was last moved. This allows a user to rest in mid-stroke in the device of FIG. 1 but not in the device of FIG. 4.

Secondly, the pneumatic cylinder 40 of exerciser 1 provides resisting force only on the pull stroke. It moves freely, with minimal resistance, on the return or push stroke. The weighted exerciser 101, on the other hand, tends to pull the lever arm 130 away from the seat 112 with equal force on both strokes.

Method of Operation

Figure 2A:
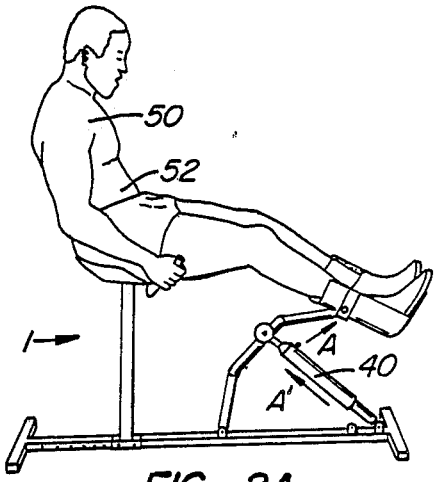
FIGS. 2A and 2B are perspective views of the device of FIG. 1 illustrating the pull stroke of an exercise.

FIGS. 2 and 3 illustrate the manner in which a user 50 exercises his or her abdominal muscles 52 on the exerciser 1 of FIG. 1.

With the feet firmly planted in the stirrups, the user begins by pulling his knees up and his legs back, as shown in FIG. 2A. As mentioned, the cylinder 40 has a resistance stroke which provides significant resistance against rotation of the lever arm in the direction of the seat and has a free stroke which provides no significant resistance upon return.

Figure 2B:
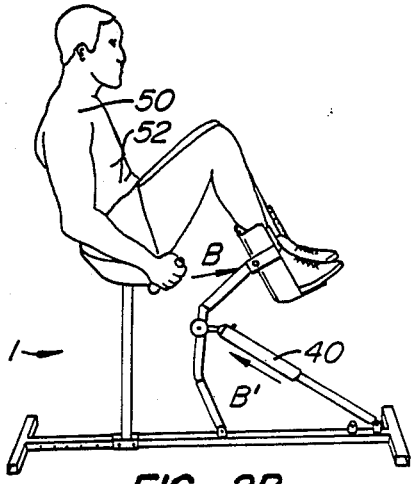

The cylinder is drawn by the lever arm in the direction of arrow A′, which movement it strongly resists. This causes pressure against the user's lower legs in the general direction of arrow A. This pressure increases the work required to bring the feet and legs forward. Turning to FIG. 2B, pressure or resistance against movement in the general direction of arrow B continues up to the top of the pull stroke where the user's knees are drawn up near to his or her chest. The cylinder continues to resist movement in the direction of arrow B′, until the pull stroke is completed.

The return, or push, stroke is shown in FIG. 3. Pushing with the soles of the feet against the base plates of the stirrups causes only minimal pressure against the feet in the direction of arrow C, since the preferred cylinder does not significantly resist movement in the direction of arrow C′. A finished cycle is shown in FIG. 3B, where the slight foot resistance indicated by arrow D and the cylinder movement indicated by arrow D′ both cease.

Continued repetition of pull and push stroke cycles provides beneficial exercise for the strengthening of the abdominal muscles.

While the above provides a full and complete disclosure of the preferred embodiments of this invention, various modifications, alternate constructions, and equivalents may be employed without departing from the true spirit and scope of the invention. As one example, a pneumatic cylinder which resists movement in both directions could be substituted for the one described. Therefore, the above description and illustrations should not be construed as limiting the scope of the invention which is defined by the appended claims.

I claim:

1. An exerciser apparatus including:

a seat attached to a base;

a lever arm pivotally attached to the base and rotatable in directions toward and away from the seat;

a pneumatic cylinder operatively connected between the base and the lever arm, the cylinder having a resistance stroke which provides significant resistance against rotation of the lever arm in the direction toward the seat, the cylinder having a free stroke which provides no significant resistance against rotation of the lever arm in the direction away from the seat;

front and rear ends of the base;

front and rear legs mounted transverse to the base on the front and rear ends of the base, respectively;

a cross bar mounted transverse to the lever arm; and a pair of foot stirrups rotatably mounted on the cross bar.

2. The apparatus of claim 1 wherein:

the foot stirrups each have a yoke, each yoke having a U-shape in a planar cross section and the foot stirrups each have a planar base plate affixed to the yoke in a plane parallel to the plane of the U-shaped cross section of the yoke.

3. The apparatus of claim 1 wherein the seat is adjustable in height.

4. An exerciser apparatus including:

a seat attached to a base, the seat being adjustable in height;

a lever arm pivotally attached to the base and rotatable in directions toward and away from the seat;

a pneumatic cylinder operatively connected between the base and the lever arm, the cylinder having a resistance stroke which provides significant resistance against rotation of the lever arm in the direction toward the seat, the cylinder having a free stroke which provides no significant resistance against rotation of the lever arm in the direction away from the seat;

front and rear ends of the base;

front and rear legs mounted transverse to the base on the front and rear ends of the base, respectively;

a cross bar mounted transverse to the lever arm; and a pair of foot stirrups mounted on the cross bar.

5. An abdominal muscle exerciser including:

a seat;

a lever arm rotatable in directions toward and away from the seat;

a base to which the seat and the lever arm are attached;

a pneumatic cylinder operatively connected between the base and the lever arm, the cylinder having a resistance stroke which provides significant resistance against rotation of the lever arm in the direction toward the seat;

front and rear ends of the base;

front and rear legs mounted transverse to the base on the front and rear ends of the base, respectively;

a cross bar mounted transverse to the lever arm; and a pair of foot stirrups rotatably mounted on the cross bar.

6. The apparatus of claim 5 further including:

means for moveable adjusting the position of the seat on the base with respect to the position of the lever arm.

7. The apparatus of claim 6 wherein:

the cylinder is biased against the lever arm by a moveable bracket.

8. The apparatus of claim 7 wherein:

the foot stirrups each have a yoke of U-shaped cross section and a planar base plate affixed to the yoke in a plane parallel to the plane of the U-shaped cross section of the yoke.

9. The apparatus of claim 8 wherein:

the yokes are padded and the base plates have patches of non-skid material.

10. An abdominal muscle exerciser including:

a seat;

a lever arm rotatable in directions toward and away from the seat;

a base to which the seat and the lever arm are attached;

a pneumatic cylinder operatively connected between the base and the lever arm, the cylinder having a resistance stroke which provides significant resistance against rotation of the lever arm in the direction toward the seat;

front and rear ends of the base;

front and rear legs mounted transverse to the base on the front and rear ends of the base, respectively;

a cross bar mounted transverse to the lever arm; and a pair of foot stirrups mounted on the cross bar.

11. The apparatus of claim 10 wherein:

the height of the seat is adjustable.

* * * * *